US010569538B2

(12) United States Patent
Matsuo

(10) Patent No.: US 10,569,538 B2
(45) Date of Patent: Feb. 25, 2020

(54) LIQUID DISCHARGE HEAD AND COMPLIANCE PLATE

(71) Applicant: SEIKO EPSON CORPORATION, Tokyo (JP)

(72) Inventor: Kenichiro Matsuo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/031,150

(22) Filed: Jul. 10, 2018

(65) Prior Publication Data

US 2019/0016131 A1 Jan. 17, 2019

(30) Foreign Application Priority Data

Jul. 11, 2017 (JP) ..... 2017-135309

(51) Int. Cl.
*B41J 2/175* (2006.01)
*B41J 2/14* (2006.01)
*B41J 2/055* (2006.01)

(52) U.S. Cl.
CPC ..... *B41J 2/055* (2013.01); *B41J 2/14233* (2013.01); *B41J 2/175* (2013.01); *B41J 2002/14241* (2013.01); *B41J 2002/14266* (2013.01); *B41J 2002/14362* (2013.01); *B41J 2002/14419* (2013.01)

(58) Field of Classification Search
CPC ..... B41J 2/055; B41J 2/175; B41J 2/14233
USPC ..... 347/84, 94
See application file for complete search history.

(56) References Cited

U.S. PATENT DOCUMENTS 9,682,551 B2 * 6/2017 Kanegae ..... B41J 2/055
2016/0229186 A1 8/2016 Kanegae

FOREIGN PATENT DOCUMENTS

JP 2014-40089 A 3/2014
JP 2016-144918 A 8/2016

* cited by examiner

*Primary Examiner* — An H Do
(74) *Attorney, Agent, or Firm* — Workman Nydegger

(57) ABSTRACT

A compliance plate includes a flexible film that forms a portion of a wall surface of a liquid storage chamber that is supplied with a liquid that is to be discharged from a nozzle, a support plate that supports the flexible film at an opposite side of the flexible film to the liquid storage chamber and that has an opening portion that exposes the flexible film, and a plurality of regions that include a first region and a second region that have a compliance function, the first region and the second region having mutually different characteristic vibration periods.

10 Claims, 13 Drawing Sheets

LIQUID DISCHARGE HEAD AND COMPLIANCE PLATE

BACKGROUND

1. Technical Field

The present invention relates to a technology that discharges a liquid such as an ink.

2. Related Art

Liquid discharge heads that discharge a liquid, such as an ink, supplied from a storage chamber to a plurality of pressure chambers, from nozzles by causing pressure changes in each pressure chamber have been proposed. In this kind of liquid discharge head, when pressure fluctuation occurs in a liquid storage chamber due to introduction of the liquid into the liquid storage chamber or pressure changes in pressure chambers, such pressure may possibly propagate to pressure chambers and result in incomplete discharge of the liquid. Therefore, such incomplete discharge of the liquid is inhibited, for example, in a liquid discharge head described in JP-A-2016-144918, in which a wall surface of a liquid storage chamber (manifold) is partly formed by a flexible film (flexible member) so that the aforementioned pressure fluctuation in the liquid storage chamber is absorbed by flexural vibration of a compliance region in the flexible film which undergoes bending.

By the way, the vibration period of pressure fluctuations that occur in the liquid storage chamber changes depending on the discharged amount of ink discharged from the liquid discharge head, the print pattern, etc. Therefore, even with a flexible film for absorbing pressure fluctuations in the liquid storage chamber as in JP-A-2016-144918, there is a risk that, depending on the vibration period of pressure fluctuations in the liquid storage chamber, the vibration period may coincide with the characteristic vibration period of the entire flexible film and therefore pressure vibration in the liquid storage chamber may resonate. When the pressure vibration in the liquid storage chamber resonates, the amplitude of the pressure vibration increases and the pressure likely exceeds the meniscus pressure resistance inside nozzles so that the menisci are destroyed resulting in incomplete discharge such as missing dot.

SUMMARY

An advantage of some aspects of the invention is that the incomplete discharge caused by resonance of pressure vibration is inhibited.

A first aspect of the invention provides a compliance plate that includes a flexible film that forms a portion of a wall surface of a liquid storage chamber that is supplied with a liquid that is to be discharged from a nozzle, a support plate that supports the flexible film at an opposite side of the flexible film to the liquid storage chamber and that has an opening portion that exposes the flexible film, a closure plate that closes the opening portion, and a plurality of regions that include a first region and a second region that have a compliance function, the first region and the second region having mutually different characteristic vibration periods. According to this aspect of the invention, when the pressure in the liquid storage chamber changes due to supply of the liquid, the flexible film oscillates to absorb the pressure change. In this aspect, because the characteristic vibration periods of the first region and the second region are differentiated from each other, the characteristic vibration period of the whole flexible film can be shifted to a period such that the pressure vibration of the liquid storage chamber does not resonate. This will prevent the meniscus in the nozzle from being destroyed by resonance of pressure vibration and therefore will inhibit incomplete discharge of the liquid.

In the first aspect of the invention, the support plate may include bar portions protruding to a side of the opening portion, and the first region and the second region may be provided with bar portions that are different in shape between the first region and the second region. According to this embodiment, since the support plate includes bar portions protruding to the opening portion side and the first region and the second region are provided with the bar portions that are different in shape between the first region and the second region, the characteristic vibration periods of the first region and the second region can be differentiated from each other. Due to this, the characteristic vibration period of the whole flexible film can be shifted to a period such that the pressure vibration of the liquid storage chamber does not resonate.

In the foregoing embodiment of the first aspect, the support plate may include bar portions protruding into the opening portion from one or both of mutually facing side surfaces of the opening portion, and the first region and the second region may be different from each other in position of the bar portions in each region. According to this embodiment, since the support plate includes the bar portions protruding into the opening portion from one or both of mutually facing side surfaces of the opening portion and the first region and the second region are different from each other in terms of the position of the bar portions in the regions, the characteristic vibration periods of the first region and the second region can be differentiated from each other. Due to this, the characteristic vibration period of the whole flexible film can be shifted to a period such that the pressure vibration of the liquid storage chamber does not resonate.

In either one of the foregoing embodiments of the first aspect, the first region and the second region may be provided with mutually different numbers of bar portions. According to this embodiment, since the first region and the second region are provided with different numbers of bar portions, the characteristic vibration periods of the first region and the second region can be differentiated from each other. Due to this, the characteristic vibration period of the whole flexible film can be shifted to a period such that the pressure vibration of the liquid storage chamber does not resonate.

In the first aspect, the support plate may be provided with island portions present inside the opening portion, and the first region and the second region may be provided with island portions that are different in shape between the first region and the second region. According to this embodiment, since the support plate is provided with island portions present inside the opening portion and the first region and the second region are provided with island portions that are different in shape between the first region and the second region, the characteristic vibration periods of the first region and the second region can be differentiated from each other. Due to this, the characteristic vibration period of the whole flexible film can be shifted to a period such that the pressure vibration of the liquid storage chamber does not resonate.

In this embodiment, the first region and the second region may be provided with mutually different numbers of the island portions. According to this embodiment, since the first region and the second region are provided with different numbers of island portions, the characteristic vibration period of the first region and the second region can be differentiated from each other. Due to this, the characteristic vibration period of the whole flexible film can be shifted to a period such that the pressure vibration of the liquid storage chamber does not resonate.

In the first aspect, the flexible film may have, at locations corresponding to the first region and the second region, portions that are different between the first region and the second region in thickness of the flexible film. According to this embodiment, since the flexible film has, at locations corresponding to the first region and the second region, portions whose flexible film thicknesses are different between the two regions, the characteristic vibration period of the first region and the second region can be differentiated from each other. Due to this, the characteristic vibration period of the whole flexible film can be shifted to a period such that the pressure vibration of the liquid storage chamber does not resonate.

A second aspect of the invention provides a liquid discharge head that includes a liquid storage chamber that is supplied with a liquid, a liquid discharge unit that discharges from a nozzle the liquid supplied from the liquid storage chamber, and a compliance plate that is disposed in the liquid storage chamber and that absorbs vibration that occurs within the liquid storage chamber. The compliance plate includes a flexible film that forms a portion of a wall surface of the liquid storage chamber that, a support plate that supports the flexible film at an opposite side of the flexible film to the liquid storage chamber and that has an opening portion that exposes the flexible film, a closure plate that closes the opening portion, and a plurality of regions that include a first region and a second region that have a compliance function, and the first region and the second region have mutually different characteristic vibration periods. According to this aspect, a liquid discharge head capable of preventing the meniscus in the nozzle from being destroyed by resonance of pressure vibration can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Exemplary Embodiment

Figure 1:
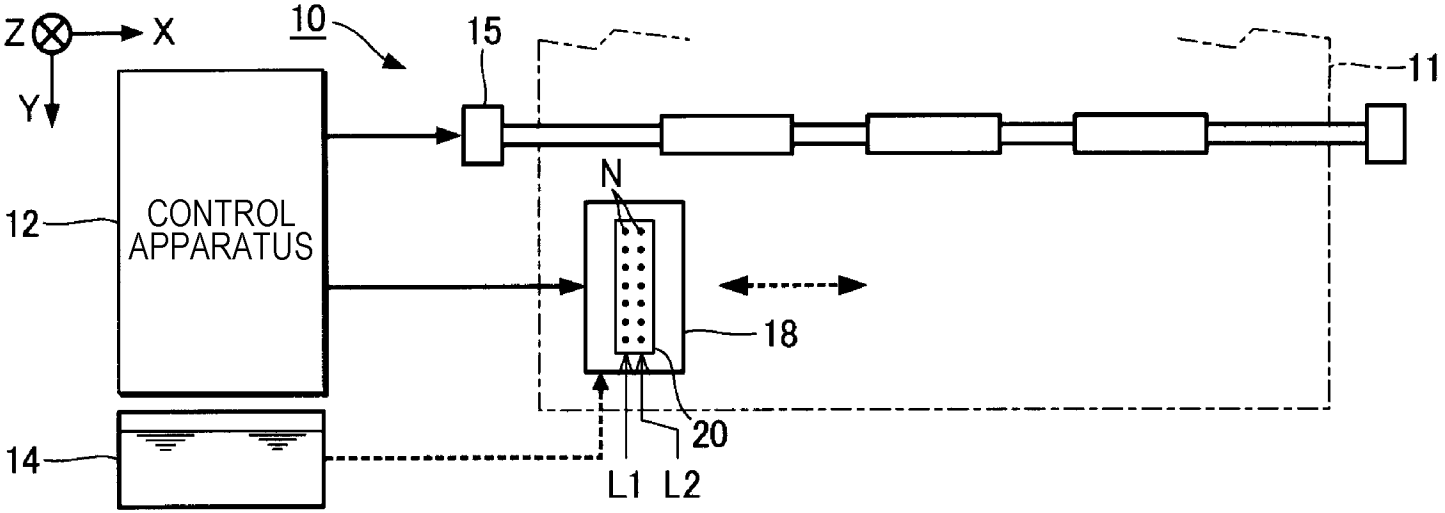
FIG. 1 is a construction diagram of a liquid discharge apparatus according to a first exemplary embodiment of the invention.

FIG. 1 is a partial construction diagram of a liquid discharge apparatus 10 according to a first exemplary embodiment of the invention. The liquid discharge apparatus 10 of the first exemplary embodiment is an ink-jet type printing apparatus that discharges ink, which is an example of a liquid, to a medium 11 such as a print sheet. The liquid discharge apparatus 10 illustrated in FIG. 1 includes a control apparatus 12, a transporting mechanism 15, a carriage 18, and a liquid discharge head 20. The liquid discharge apparatus 10 is equipped with a liquid container 14 that stores ink.

The liquid container 14 is an ink tank type cartridge made up of a box-shaped container that is detachably attached to a main body of the liquid discharge apparatus 10. The liquid container 14 does not need to be a box-shaped container but may also be an ink pack type cartridge made up of a bag-shaped container. The liquid container 14 stores ink. The ink may be a black ink or may also be a color ink. The ink stored in the liquid container 14 is forced to flow to a liquid discharge head 20 by a pump (not depicted).

The control apparatus 12 collectively controls various elements of the liquid discharge apparatus 10. The transporting mechanism 15 transports the medium 11 in Y directions under control by the control apparatus 12. The liquid discharge head 20 discharges the ink supplied from the liquid container 14 from a plurality of nozzles N to the medium 11 under control by the control apparatus 12.

The liquid discharge head 20 is mounted on the carriage 18. Although FIG. 1 illustrates an example in which one liquid discharge head 20 is mounted on the carriage 18, this does not limit the invention but a plurality of liquid discharge heads 20 may be mounted on the carriage 18. The control apparatus 12 moves the carriage 18 back and forth in X directions that intersect the Y directions (orthogonally in FIG. 1). Concurrently with the transportation of the medium 11 and the back and forth movements of the carriage 18, the liquid discharge head 20 discharges the ink to the medium 11 so that a desired image is formed on a surface of the medium 11. Note that a plurality of liquid discharge heads 20 may be mounted on the carriage 18. The directions perpendicular to an X-Y plane (a plane parallel to a surface of the medium 11) will be termed Z directions.

Liquid Discharge Head

Figure 2:
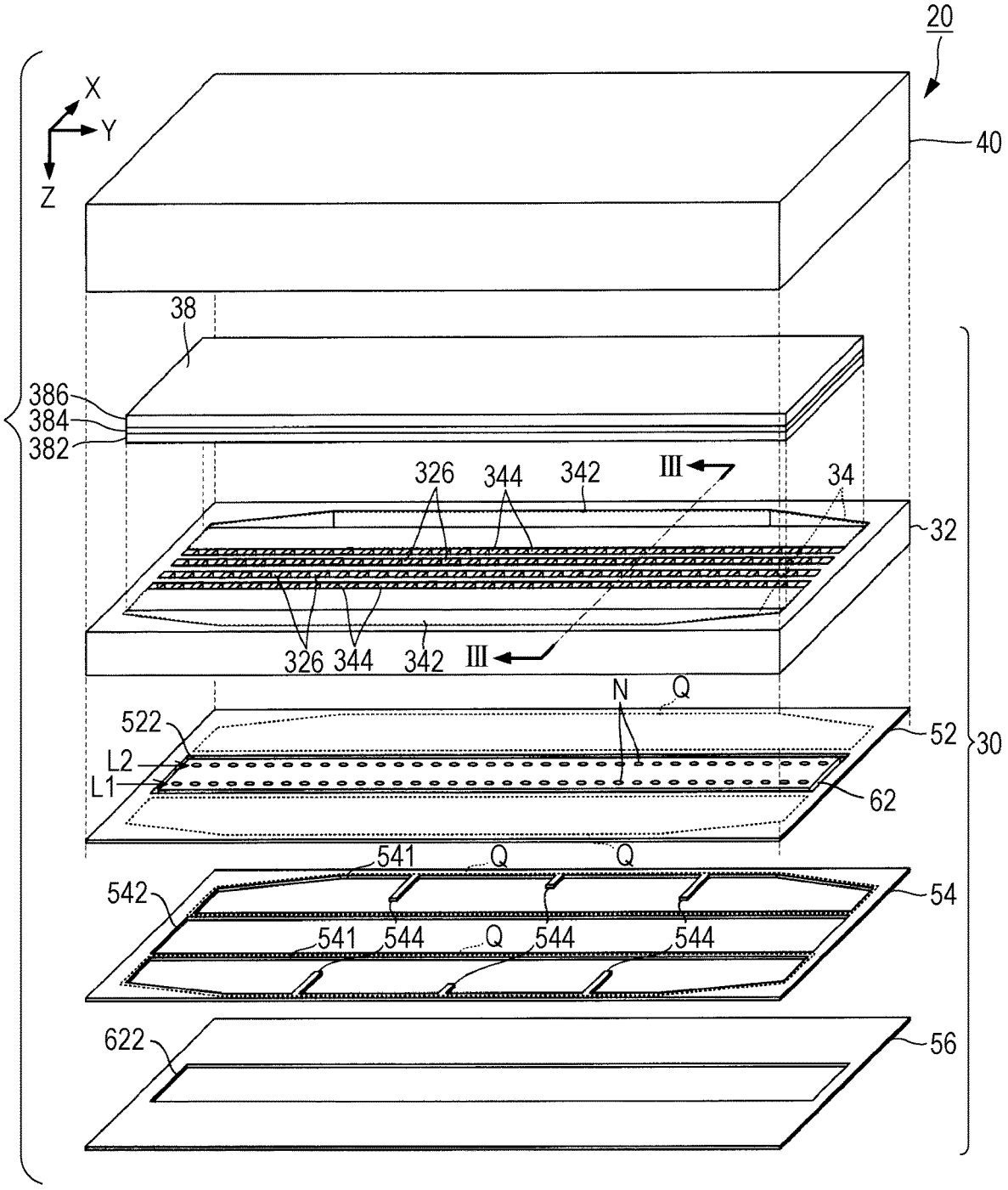
FIG. 2 is an exploded perspective view of a liquid discharge head.
Figure 3:
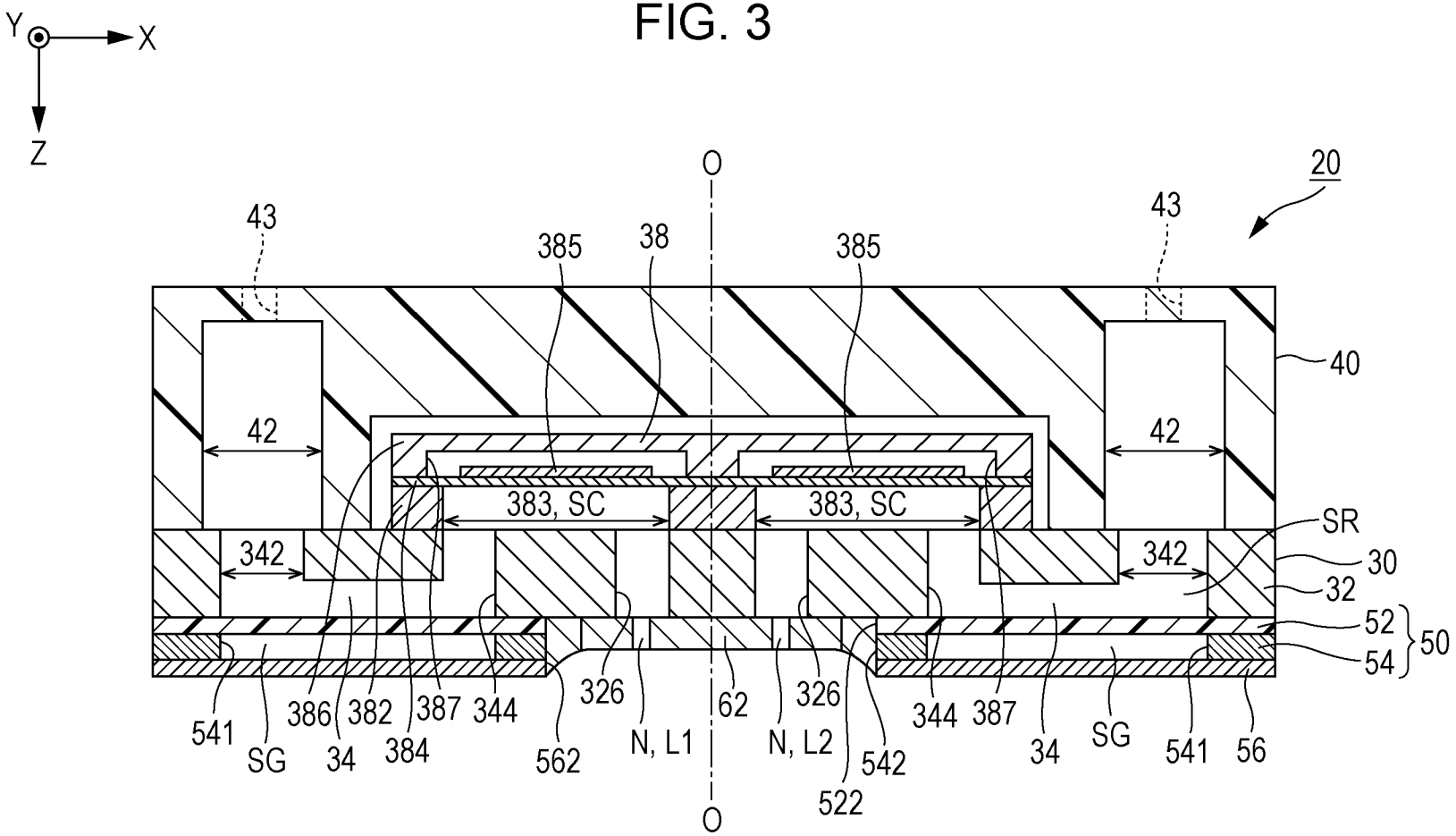
FIG. 3 is a sectional view of the liquid discharge head taken on line III-III of FIG. 2.

FIG. 2 is an exploded perspective view of the liquid discharge head 20. FIG. 3 is a sectional view of the liquid discharge head 20 taken on line III-III of FIG. 2. As illustrated in FIG. 2 and FIG. 3, the liquid discharge head 20 is constructed by fixing (joining) a case member 40 to a head body 30 that has a discharge surface that is provided with the nozzles N that discharge the ink. The head body 30 is a structural body that includes a communication substrate 32 and further includes, on a side of the communication substrate 32 (a positive Z direction-side surface thereof), a compliance plate 50 and a nozzle plate 62 provided with the nozzles N and, on the opposite side of the communication substrate 32 (a negative Z direction-side surface thereof), a stack unit 38 that includes a pressure chamber substrate 382. These elements of the head body 30 are fixed to each other by, for example, adhesive.

The nozzle plate 62 is a flat platy member that forms a discharge surface that is provided with the plurality of nozzles N aligned in the Y directions. The nozzle plate 62 is formed from, for example, a silicon material. The nozzles N are made up of two rows of nozzles, that is, nozzle rows L1 and L2. The nozzle rows L1 and L2 are each a set of nozzles N aligned in the Y directions. Note that the arrangement of the nozzle rows L1 and L2 is not limited to what is depicted in conjunction with this exemplary embodiment. For example, the nozzle rows L1 and L2 may be arranged so that the nozzles of the two rows L1 and L2 are staggered from each other along the Y directions. Furthermore, the number of rows of nozzles formed in the nozzle plate 62 is not limited to two but may also be, for example, one.

Figure 4:
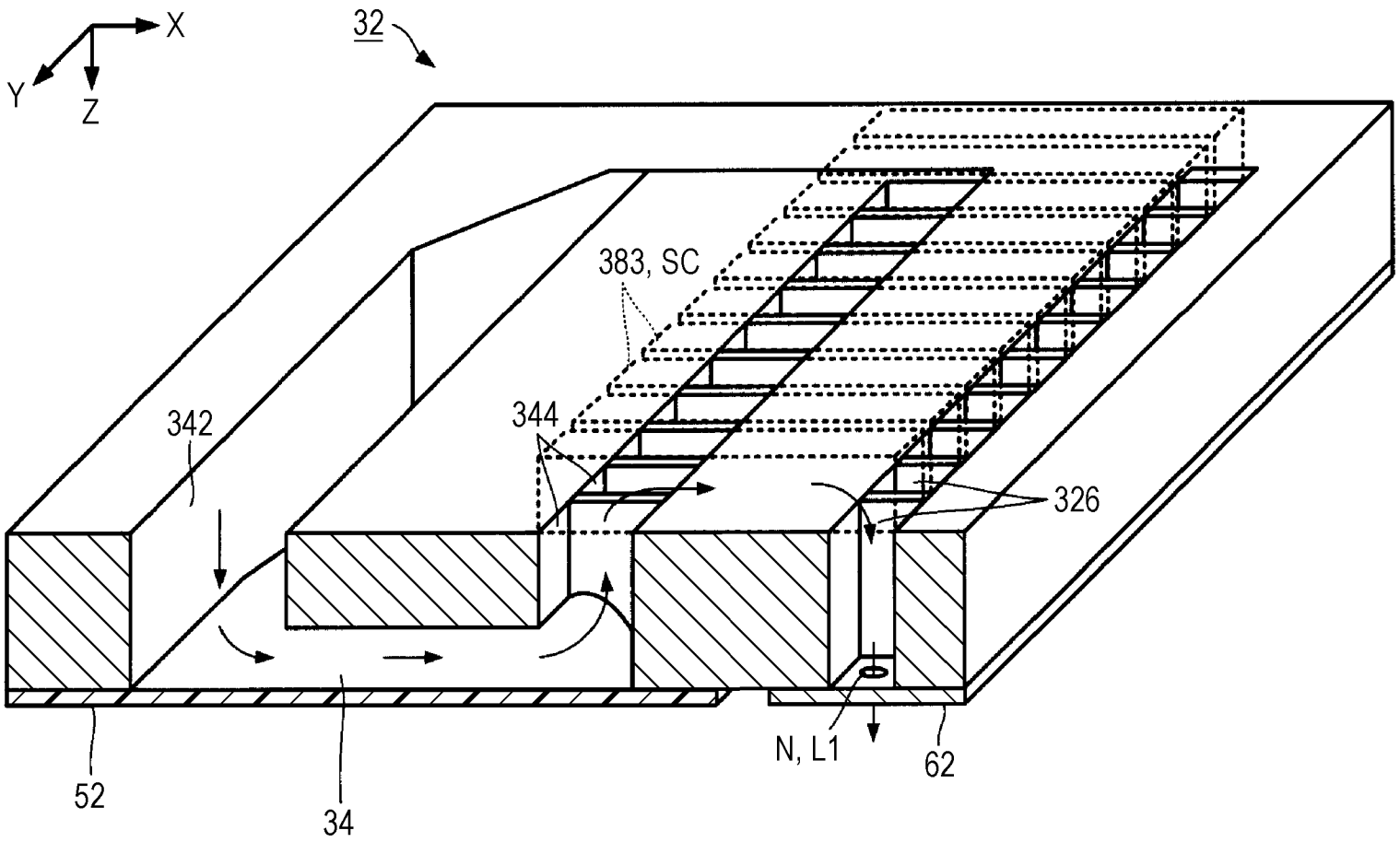
FIG. 4 is a cross-sectional perspective view of the liquid discharge head.

In the liquid discharge head 20 according to this exemplary embodiment, a structure that corresponds to the nozzle row L1 (a left side portion in FIG. 3) and a structure that corresponds to the nozzle row L2 (a right side portion in FIG. 3) are substantially axially symmetric with respect to an imaginary line O-O extending in the X directions. The two structures are substantially identical. Therefore, the following description will focus on the structure that corresponds to the nozzle row L1 (the portion on the left side of the imaginary line O-O in FIG. 3) and the description of elements that correspond to the nozzle row L2 will be omitted below for the sake of convenience. FIG. 4 is a cross-sectional perspective view of the structure that corresponds to the nozzle row L1. In FIG. 4, a plurality of pressure chambers SC are illustrated by interrupted lines.

The communication substrate 32 illustrated in FIGS. 2 to 4 is a flat platy flow path substrate that forms an ink flow path. The communication substrate 32 is formed from, for example, a silicon material. The communication substrate 32 is provided with a second liquid storage chamber 34 and a plurality of nozzle-side communication flow paths 326. The second liquid storage chamber 34 has an inlet opening 342 and a plurality of supply-side communication flow paths 344. The supply-side communication flow paths 344 and the nozzle-side communication flow paths 326 are through holes formed separately for each nozzle N. The second liquid storage chamber 34 is an opening common to a plurality of nozzles N.

The stack unit 38 is formed by stacking a pressure chamber substrate 382, a vibration plate 384, and a protective plate 386 in that order. The pressure chamber substrate 382 and the vibration plate 384 form the pressure chambers SC that communicate with the nozzles N. However, the configuration of the stack unit 38 is not limited to this configuration; for example, the protective plate 386 may be omitted. The pressure chamber substrate 382 is provided with a plurality of opening portions 383 that form the pressure chambers SC (cavities) that communicate with the nozzles N. The pressure chamber substrate 382 is formed from, for example, a silicon material as is the case with the communication substrate 32.

The vibration plate 384 is disposed on the opposite side surface of the pressure chamber substrate 382 to the communication substrate 32. The vibration plate 384 is a flat platy member capable of being elastically vibrated. The vibration plate 384 and the communication substrate 32 face each other across a space in each of the opening portions 383 formed by the pressure chamber substrate 382. The spaces formed inside the opening portions 383 of the pressure chamber substrate 382 between the communication substrate 32 and the vibration plate 384 form the pressure chambers SC that generate pressure for discharging the ink from the nozzles N. The supply-side communication flow paths 344 of the communication substrate 32 provide communication between the second liquid storage chamber 34 (described below) and the pressure chambers SC. The nozzle-side communication flow paths 326 of the communication substrate 32 provide communication between the pressure chambers SC and the nozzles N.

The opposite side surface of the vibration plate 384 to the pressure chamber substrate 382 is provided with a plurality of piezoelectric elements 385 that correspond one-to-one to the nozzles N (the pressure chambers SC). Each piezoelectric element 385 is a driving element in which a piezoelectric body is sandwiched between electrodes facing each other. The individual piezoelectric elements 385 vibrate independently of each other due to a drive signal supplied from the control apparatus 12. The protective plate 386 is an element that protects the piezoelectric elements 385 and is fixed to the surface of the pressure chamber substrate 382 (of the vibration plate 384) by, for example, adhesive. The piezoelectric elements 385 are housed in a recess portion 387 that is formed on a vibration plate 384-side surface of the protective plate 386. When a piezoelectric element 385 vibrates according to a drive signal supplied from the control apparatus 12, the vibration plate 384 oscillates together with the piezoelectric element 385. As a result, the pressure of the ink inside the pressure chambers SC changes so that the ink is discharged from the nozzle N. Thus, the piezoelectric elements 385 function as pressure generator elements that change the pressure in the pressure chambers SC so that the ink within the pressure chambers SC is discharged from the nozzles N. Incidentally, the piezoelectric elements 385 are connected to the control apparatus 12 via a flexible printed cable (FPC), a chip-on-film (COF), etc. (none of which is depicted).

A positive Z direction-side surface of the case member 40 (hereinafter, referred to as "junction surface" of the case member 40) is fixed to the negative Z direction-side surface of the communication substrate 32 by, for example, adhesive. The case member 40 is formed from, for example, a molding resin material such as a plastic material. When the case member 40 is formed from a molding resin material, the case member 40 can be monolithically molded by injection molding of the molding resin material. The case member 40 is a case for storing the ink supplied to the pressure chambers SC and is a structural body provided with a first liquid storage chamber 42 that communicates with the second liquid storage chamber 34 through the inlet opening 342 as an opening portion. The first liquid storage chamber 42 communicates with an introduction port 43 for introducing the ink.

The second liquid storage chamber 34 and the first liquid storage chamber 42 formed as described above are each a space common to the plurality of nozzles N and store the ink supplied from the liquid container 14 through the introduction port 43. The second liquid storage chamber 34 is a space elongated in the Y directions. The second liquid storage chamber 34 in this exemplary embodiment has such a shape that the flow path becomes wider from the inlet opening 342 side to the supply-side communication flow path 344 (outlet opening) side. The pressure chambers SC are arrayed in one direction (Y directions) and the supply-side communication flow paths 344 are arrayed in the Y directions along the array of the pressure chambers SC.

As illustrated in FIG. 4, the ink having flowed from the first liquid storage chamber 42 into the second liquid storage chamber 34 is divided into the supply-side communication flow paths 344 and supplied in parallel to the pressure chambers SC, filling each pressure chamber Sc. Then, due to pressure changes according to vibration of the vibration plate 384, the ink is discharged from a pressure chamber SC to the outside through the corresponding nozzle-side communication flow path 326 and nozzle N. Specifically, the pressure chambers SC function as spaces in which pressures for discharging the ink from the nozzles N are generated, and the second liquid storage chamber 34 and the first liquid storage chamber 42 function as a liquid storage chamber SR (a reservoir or a manifold) for storing the ink that is to be supplied to the pressure chambers SC.

Compliance Plate

The compliance plate 50 illustrated in FIG. 3 is an element for inhibiting pressure changes of the ink in the liquid storage chamber SR and includes a flexible film 52 (compliance substrate) and a support plate 54. The flexible film 52 is a flexible member having a film shape, and constitutes a portion of a wall surface of the liquid storage chamber SR (concretely, a portion of a bottom surface thereof). Although FIG. 3 illustrates a configuration where the second liquid storage chamber 34 that corresponds to the nozzle row L1 and the second liquid storage chamber 34 that corresponds to the nozzle row L2 are sealed by the single flexible film 52, the invention is not limited by this configuration. For example, the two second liquid storage chambers 34 may be sealed by separate flexible films 52 The support plate 54 is a flat plate formed from a highly rigid material such as stainless steel (SUS), and supports the flexible film 52 so that the flexible film 52 closes the liquid storage chamber SR. The support plate 54 has, in a region that coincides with the liquid storage chamber SR in a plan view (viewed in the Z direction), an opening portion 541 that exposes the flexible film 52. The region in the flexible film 52 which exposes the opening portion 541 is a compliance region Q that has a compliance function of, due to deformation (flexural vibration) of the flexible film 52, absorbing pressure changes in the liquid storage chamber SR. Furthermore, the space inside the opening portion 541 of the support plate 54 communicates with the atmosphere and therefore functions as a compliance space SG that allows the flexible film 52 to deform so as to absorb pressure changes in the liquid storage chamber SR.

The compliance plate 50 is fixed to a fixture plate 56. The fixture plate 56 has been formed so as to have a predetermined shape from a highly rigid material a highly rigid material, for example, a stainless steel or the like. The fixture plate 56 is provided with an opening portion 622 that corresponds to the nozzle plate 62. The flexible film 52 is provided with an opening portion 522 that corresponds to the opening portion 622. Similarly, the support plate 54 is also provided with an opening portion 542 that corresponds to the opening portion 622. As for the compliance plate 50, the support plate 54 is fixed to the fixture plate 56 so that the nozzle plate 62 is exposed through the opening portions 522, 542, and 562. Note that a space inside the opening portions 522, 542 and 562 (concretely, a gap between inner peripheral surfaces of the opening portions 522, 542 and 562 and an outer peripheral surface of the nozzle plate 62) is filled with a filler formed from, for example, a resin material.

The positive Z direction-side side of the opening portion 541 of the support plate 54 is closed by the fixture plate 56. A space inside the opening portion 542 sandwiched between the fixture plate 56 and the flexible film 52 forms the aforementioned compliance space SG. Thus, the fixture plate 56 in this exemplary embodiment functions as a closure plate that closes the opening portion 542 of the support plate 54. Therefore, the fixture plate 56 in this exemplary embodiment, serving as a closure plate, is a component element of the compliance plate 50. However, the closure plate that closes the opening portion 542 may instead be provided integrally with the support plate 54. In this case, the fixture plate 56 in the exemplary embodiment is not a component element of the compliance plate 50. According to the compliance plate 50 configured as described above, even if a pressure change occurs in the liquid storage chamber SR when the ink is forced to flow and therefore introduced into the liquid storage chamber SR, the flexible film 52 deforms so that the pressure change can be absorbed.

By the way, the vibration period of pressure changes that occur in the liquid storage chamber SR changes depending on the amount of the ink discharged from the liquid discharge head 20, the print pattern, etc. Therefore, there is a risk that, depending on the vibration period of pressure changes in the liquid storage chamber SR, the vibration period may coincide with the characteristic vibration period of the flexible film 52 and therefore pressure vibration in the liquid storage chamber SR may resonate. When the pressure vibration in the liquid storage chamber SR resonates, the amplitude of the pressure vibration increases and the pressure likely exceeds the meniscus pressure resistance inside nozzles N so that the menisci are destroyed, resulting in incomplete discharge such as missing dot.

For example, it has been made clear that missing dot due to resonance occurs with a print pattern in which solid-printing discharge (a discharge duty of 100%), excitation (e.g., repeated alternations of discharge (printing) and non-discharge (blank)), and solid-printing discharge serially occur. The discharge duty here is the proportion of the discharged amount of ink to the maximum discharged amount of ink per unit time.

Figure 5:
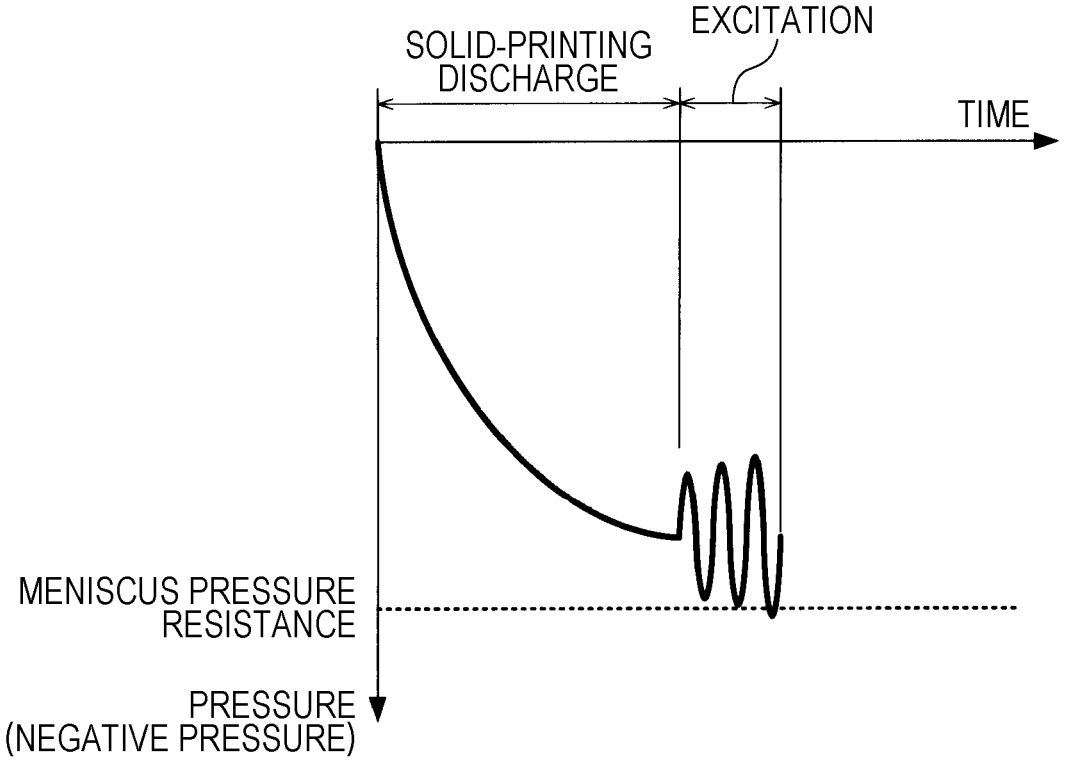
FIG. 5 is a graph indicating changes in the pressure in a liquid storage chamber with a specific print pattern.

FIG. 5 is a graph indicating changes in pressure in the liquid storage chamber SR with such a specific print pattern that missing dot occurs due to resonance. In FIG. 5, the vertical axis indicates pressure (negative pressure) and the horizontal axis indicates time. As indicated in FIG. 5, during solid-printing discharge, the amount of ink discharged is large so that the pressure in the nozzles N sharply decreases; therefore, the menisci in the nozzles N considerably pulled to the pressure chamber SC side. Hence, during the subsequent excitation, the pressure vibration resonates and the amplitude thereof increases so that the pressure likely exceeds the meniscus pressure resistance, resulting in occurrence of missing dot during the immediately subsequent solid-printing discharge. Thus, it has been made clear that when resonance of pressure vibration occurs, changes in pressure in the liquid storage chambers SR cannot be absorbed and, moreover, the amplitude of pressure vibration in the liquid storage chambers SR increases, giving rise to a factor of incomplete discharge.

Therefore, the compliance plate 50 of this exemplary embodiment is configured so that a first region and a second region that are different regions in the aforementioned compliance region Q are different from each other in characteristic vibration period. Thus, in the compliance plate 50, locally providing regions with different characteristic vibration periods can shift the characteristic vibration period of the whole flexible film 52 to a period such that the pressure vibration of the liquid storage chamber SR does not resonate.

Figure 6:
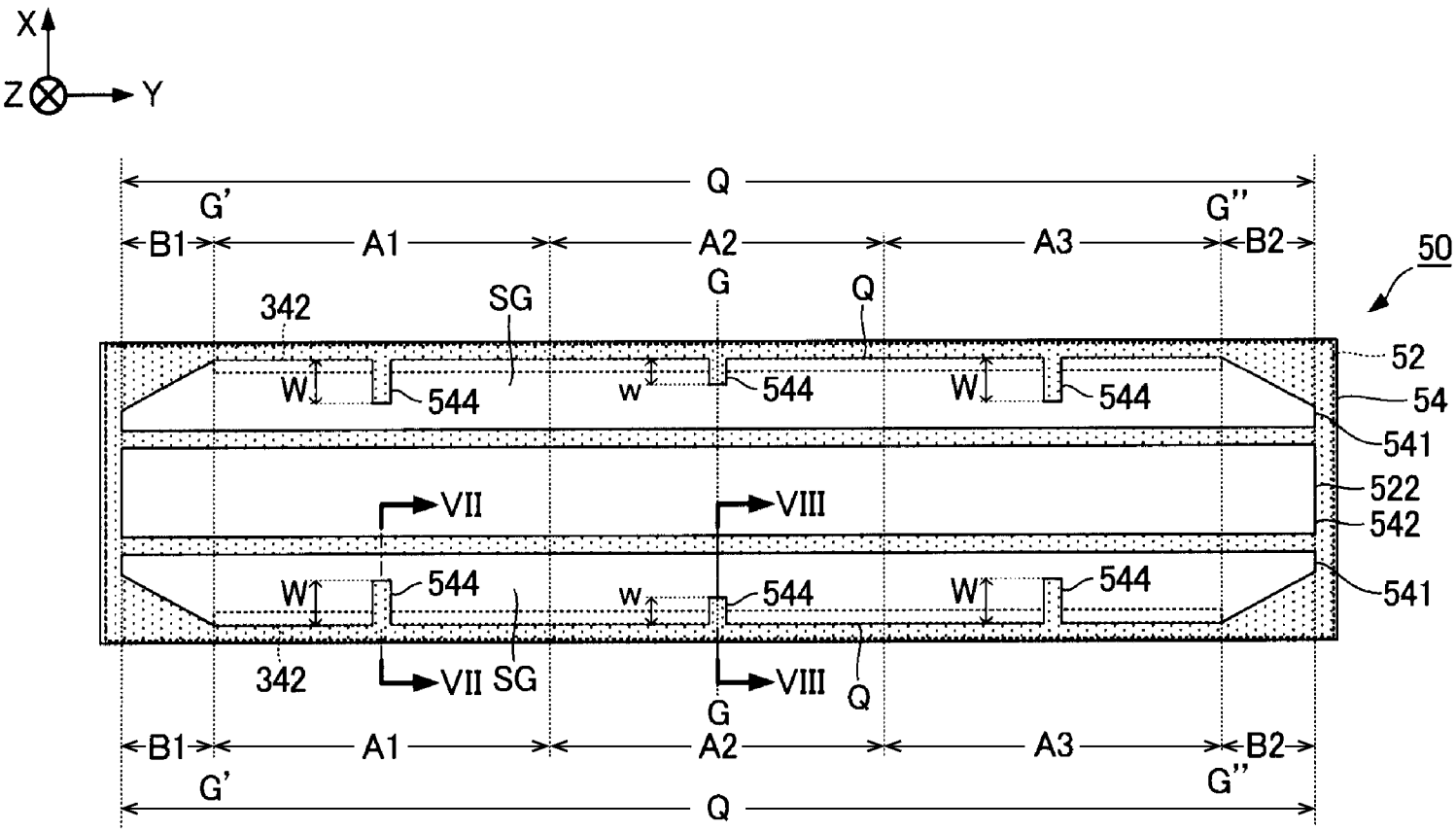
FIG. 6 is a plan view of a compliance plate in the first exemplary embodiment.

A configuration example of the compliance plate 50 that can shift the characteristic vibration period of the whole flexible film 52 as described above will be described below. FIG. 6 is a plan view of the compliance plate 50 of the first exemplary embodiment taken in the Z direction. The compliance region Q in this exemplary embodiment includes a positive X direction-side region that corresponds to a liquid storage chamber SR of the nozzle row L1 and a negative X direction-side region that corresponds to a liquid storage chamber SR of the nozzle row L2. These regions, although facing in the opposite X directions, have substantially the same configuration. Therefore, the following description will focus on the positive X direction-side region that corresponds to the liquid storage chamber SR of the nozzle row L1 while description of elements that correspond to the negative X direction-side region that correspond to the liquid storage chamber SR of the nozzle row L2 is omitted for the sake of convenience.

As illustrated in FIG. 6, the compliance region Q is elongated in the Y directions, and its negative Y direction-side region and positive Y direction-side region are substantially axially symmetric with respect to an imaginary line G-G extending in the X directions through a center of the compliance region Q. The compliance region Q has a shape substantially conforming to the shape of the second liquid storage chamber 34 in which the flow path becomes gradually wider from the inlet opening 342 side toward an end in the negative X direction. Therefore, the width of the compliance region Q in the X directions is constant between an imaginary line G'-G' relatively near to an end portion in the negative Y direction from the imaginary line G-G and an imaginary line G"-G" relatively near to an end portion in the positive Y direction from the imaginary line G-G. The width of the compliance region Q in the X directions decreases gradually from the imaginary line G'-G' toward the negative Y direction-side end portion. Likewise, the width of the compliance region Q in the X directions decreases gradually from the imaginary line G"-G" to the positive Y direction-side end portion.

Therefore, in the compliance region Q in this exemplary embodiment, the region whose width in the X directions is constant is equally divided into three regions: an A1 region, an A2 region, and A3 region, as illustrated in FIG. 6. However, how to divide the compliance region Q into regions whose characteristic vibration periods are differentiated is not limited to this example. In this exemplary embodiment, for example, if the A1 region (or the A3 region) is termed a first region and the A2 region is termed a second region, the first region and the second region are configured to be different from each other in characteristic vibration period.

Concretely, the A1 region, the A2 region, the A3 region of the compliance region Q are each provided with a cantilever-shaped bar portion 544, and the bar portion 544 of the A1 region (A3 region) and the bar portion 544 of the A2 region are differentiated in shape (length, width, external shape, thickness, size, etc.). According to this configuration, since the A1 region (A3 region) and the A2 region have bar portions 544 different in shape between the two regions, the characteristic vibration periods of the A1 region (A3 region) and the A2 region can be differentiated from each other relatively easily in comparison with the case where the A1 region (A3 region) and the A2 region are the same in the shape of the bar portions 544 in the two regions. By differentiating the characteristic vibration periods of the A1 region (A3 region) and the A2 region in this manner, the characteristic vibration period of the whole flexible film 52 can be shifted to a period such that the pressure vibration of the liquid storage chamber SR does not resonate even in, for example, the case of a print pattern as illustrated in FIG. 5. This will prevent menisci in the nozzles N from being destroyed by resonance of pressure vibration and therefore will inhibit incomplete discharge of the ink.

Figure 7:
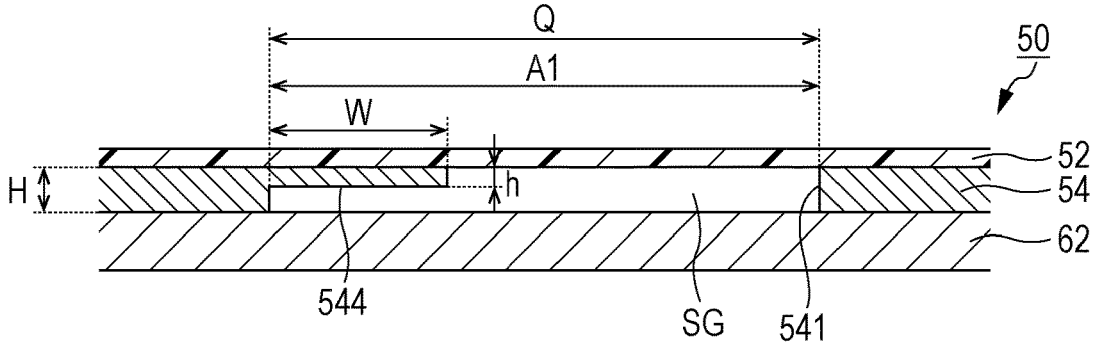
FIG. 7 is a sectional view of a first region illustrated in FIG. 6 which is taken on line VII-VII.
Figure 8:
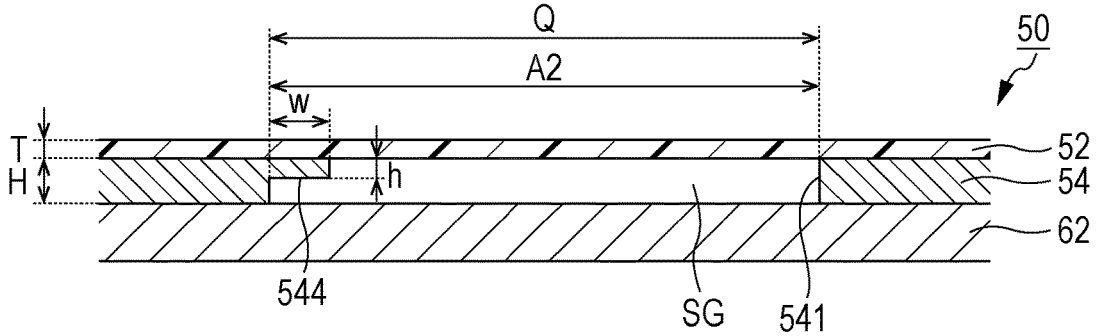
FIG. 8 is a sectional view of a second region illustrated in FIG. 6 which is taken on line VIII-VIII.

FIG. 6 illustrates an example in which the characteristic vibration period of the A2 region is differentiated from the characteristic vibration period of the A1 region (the characteristic vibration period of the A3 region) by making the length of the bar portion 544 of the A2 region less than the length of the bar portion 544 of the A1 region (the length of the bar portion 544 of the A3 region). FIG. 7 is a sectional view of the A1 region of the compliance plate 50 taken along a line VII-VII of FIG. 6. FIG. 8 is a sectional view of the A2 region of the compliance plate 50 taken along a line VIII-VIII of FIG. 6.

As illustrated in FIG. 7 and FIG. 8, the bar portions 544 are provided in the compliance space SG (in the opening portion 541). The bar portions 544 extend in the X direction inside the opening portion 541 of the support plate 54, from an inlet opening 342-side side surface toward an opening portion 542-side side surface of the opening portion 541, protruding from the inlet opening 342-side side surface into the compliance space SG. Each bar portion 544 is coupled to the inlet opening 342-side side surface of the support plate 54 and is apart from the opening portion 542-side side surface. Incidentally, in exemplary embodiment, the end portion side of the bar portion 544 which is coupled to the support plate 54 is termed the support side, and the end portion side thereof protruding into the compliance space SG is termed the distal end side.

Each bar portion 544 is fixed at least at a portion thereof to the flexible film 52 and the distal end side portion of each bar portion 544 is not fixed to the fixture plate 56. Concretely, the entire surface of each bar portion 544 which faces the flexible film 52 is fix to the flexible film 52 by adhesive or the like. Note that it suffices that each bar portion 544 is fixed at least at a portion thereof to the flexible film 52, and the portion of each bar portion 544 which is fixed to the flexible film 52 may be on the distal end side or may also be on the support side. The thickness h of the bar portions 544 is less than the thickness H of the support plate 54, and a gap is formed between each portion 544 and the fixture plate 56.

The bar portions 544 thus provided reduce flexural deformation of the compliance region Q during the printing standby mode, so that the range in which flexural deformation of the compliance region Q is possible during printing can be reduced. In this exemplary embodiment, the bar portions 544 are varied in shape so that the compliance region Q include regions that have mutually different characteristic vibration periods.

Concretely, the length w of the bar portion 544 in the A2 region which is measured from the support side to the distal end side (the length thereof in X direction) is made less than the length W of the bar portions 544 in the A1 region and the A3 region. According to this configuration, the range in which the flexible film 52 can be flexurally deformed by the bar portion 544 of the A2 region is smaller than the range in which the flexible film 52 can be flexurally deformed by the bar portion 544 of the A1 region. Therefore, the characteristic vibration period of the A2 region can be differentiated from the characteristic vibration period of the A1 region. Thus, differentiating the characteristic vibration periods of the A1 region (A3 region) and the A2 region from each other can shift the characteristic vibration period of the whole flexible film 52 to a period such that the pressure vibration of the liquid storage chamber SR does not resonate. The exemplary embodiment has been described in conjunction with an example in which the bar portions 544 of the A3 region and the A1 region have the same length. However, the invention is not limited to this, but the bar portions 544 of the A3 region and the A1 region may be made different between the two regions in length.

Figure 9:
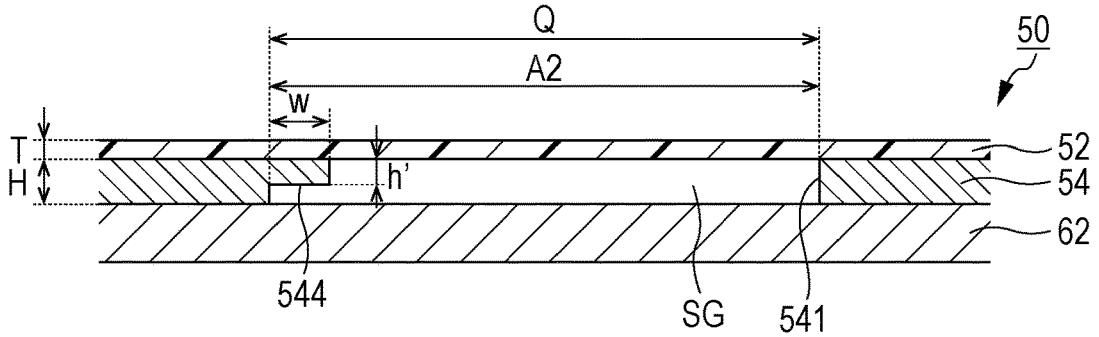
FIG. 9 is a sectional view of an A2 region according to a first modification of the first exemplary embodiment.

FIG. 9 is a sectional view of the A2 region of a compliance plate 50 according to a first modification of the first exemplary embodiment, corresponding to FIG. 8. Note that a sectional view of the A1 region in the first modification of the first exemplary embodiment is substantially the same as the sectional view in FIG. 7. FIGS. 6 to 8 illustrate examples in which the support plate 54 has, in the A1 region (A3 region) and the A2 region, bar portions 544 whose lengths are different between the two regions. However, the invention is not limited to this, but the support plate 54 may have, in the A1 region (A3 region) and the A2 region, bar portions 544 whose thicknesses are different between the two regions. For example, as illustrated in FIG. 9, the thickness h' of the bar portion 544 (the thickness thereof in the Z direction) of the A2 region may be greater than the thickness h of the bar portions 544 of the A1 region and the A3 region. Note that in the case where the bar portions 544 are varied in thickness, the bar portions 544 do not need to be varied in length.

Figure 10:
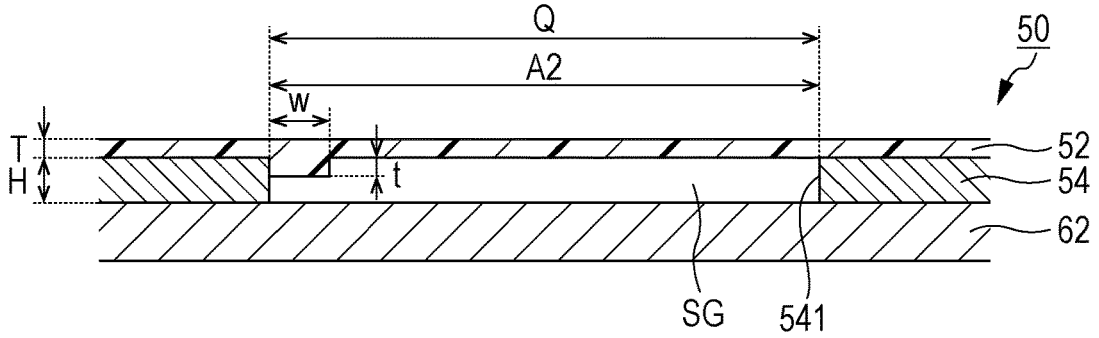
FIG. 10 is a sectional view of an A2 region according to a second modification of the first exemplary embodiment.

FIG. 10 is a sectional view of the A2 region in a compliance plate 50 according to a second modification of the first exemplary embodiment, corresponding to FIG. 9. Note that a sectional view of the A1 region in the second modification of the first exemplary embodiment is substantially the same as the sectional view in FIG. 7. FIG. 9 illustrates an example in which the support plate 54 has, in the A1 region (A3 region) and the A2 region, bar portions 544 whose thicknesses are different between the two regions. However, the invention is not limited to this. Instead of providing bar portions 544, a flexible film 52 whose thickness is different between the A1 region (A3 region) and the A2 region may be provided. For example, as illustrated in FIG. 10, the thickness t of the flexible film 52 in the A2 region is made greater than the thickness T of the flexible film 52 in the A1 region (A3 region) so that the flexible film 52 in the A2 provides a configuration identical in shape to the bar portion 544 illustrated in FIG. 9. Note that a portion of the flexible film 52 which is varied in thickness from other portions thereof does not need to be identical in shape to the bar portion 544 illustrated in FIG. 9. Furthermore, an arrangement in which the A1 region (A3 region) and the A2 region have bar portions 544 different in shape and the flexible film 52 is varied in thickness may also be adopted. Thus, arrangements in which the A1 region (A3 region) and the A2 region are provided with bar portions 544 of the support plate 54 which are different in thickness between the two regions or provided with portions of the flexible film 52 which are different in thickness between the two regions can also differentiate the characteristic vibration periods of the A1 region (A3 region) and the A2 region from each other, and therefore can shift the characteristic vibration period of the whole flexible film 52 to a period such that the pressure vibration of the liquid storage chamber SR does not resonate.

Figure 11:
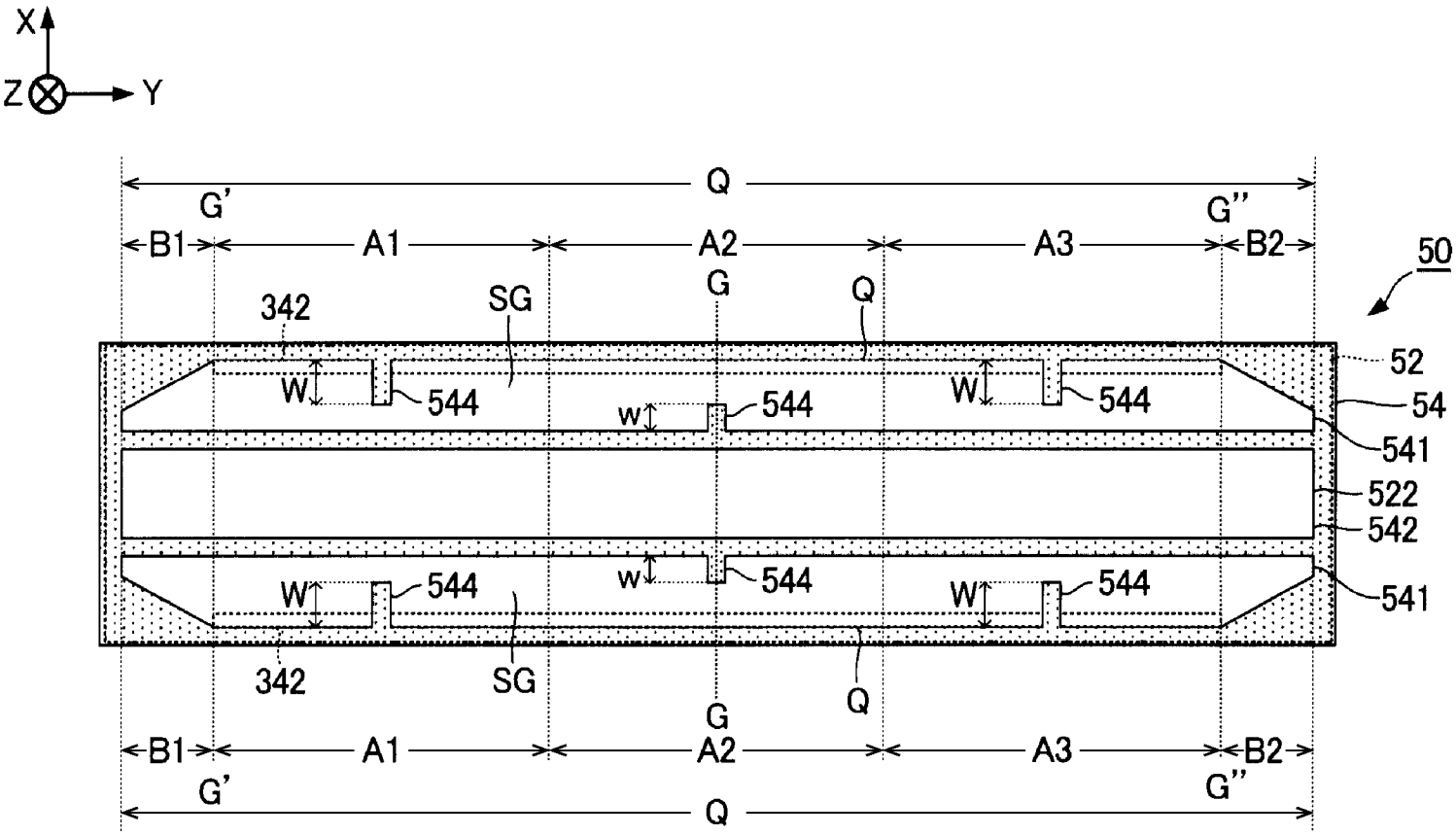
FIG. 11 is a plan view of a compliance plate according to a third modification of the first exemplary embodiment.

FIG. 11 is a plan view of a compliance plate 50 according to a third modification of the first exemplary embodiment, corresponding to FIG. 6. Although FIG. 6 illustrates an example in which the bar portions 544 each protrude from the inlet opening 342-side side surface of opposite side surfaces of a corresponding one of the opening portions 541 into the opening portion 541 and are provided at identical positions in their respective ones of the A1 region (A3 region) and A2 region, the invention is not limited by this example. The support plate 54 may be provided with bar portions 544 protruding into the opening portion 541 from the opening portion 542-side side surface, or the A1 region (A3 region) and the A2 region may be provided with bar portions 544 whose positions in their respective regions are different between the two regions.

For example, as illustrated in FIG. 11, the A1 region (A3 region) may be provided with a bar portion 544 protruding from the inlet opening 342-side side surface of the opening portion 541 into the opening portion 541, and the A2 region may be provided with a bar portion 544 protruding from the opening portion 542-side side surface of the opening portion 541 into the opening portion 541. Although in the foregoing example, the A1 region, the A2 region, and the A3 region are provided with the bar portions 544 that protrude alternately, one by one, from the two mutually facing side surfaces of the opening portion 541, the invention is not limited to this arrangement. Sets of adjacent two or more bar portions 544 may protrude alternately, one set by one set, from the two mutually facing side surfaces of the opening portion 541. Furthermore, an arrangement of bar portions 544 other than alternate arrangements may also be adopted. Still further, in the case where the A1 region (A3 region) and the A2 region are varied from each other in terms of the positions of bar portions 544, the lengths of the bar portions 544 do not need to be varied.

Furthermore, bar portions 544 may also protrude from the two mutually facing side surfaces of the opening portion 541 into the opening portion 541 (i.e., into the space thereof). In this arrangement, at least one of the A1 region, the A2 region, and the A3 region may be provided with a bar portion 544 protruding from one of the two mutually facing side surfaces of the opening portion 541 and another one of them may be provided with bar portions 544 protruding from the two mutually facing side surfaces of the opening portion 541. Such a configuration in which the A1 region (A3 region) and the A2 region are provided with the bar portions 544 whose positions in their respective regions are different between the two regions can differentiate the characteristic vibration periods of the A1 region (A3 region) and the A2 region from each other and therefore can shift the characteristic vibration period of the whole flexible film 52 to a period such that the pressure vibration of the liquid storage chamber SR does not resonate.

Figure 12:
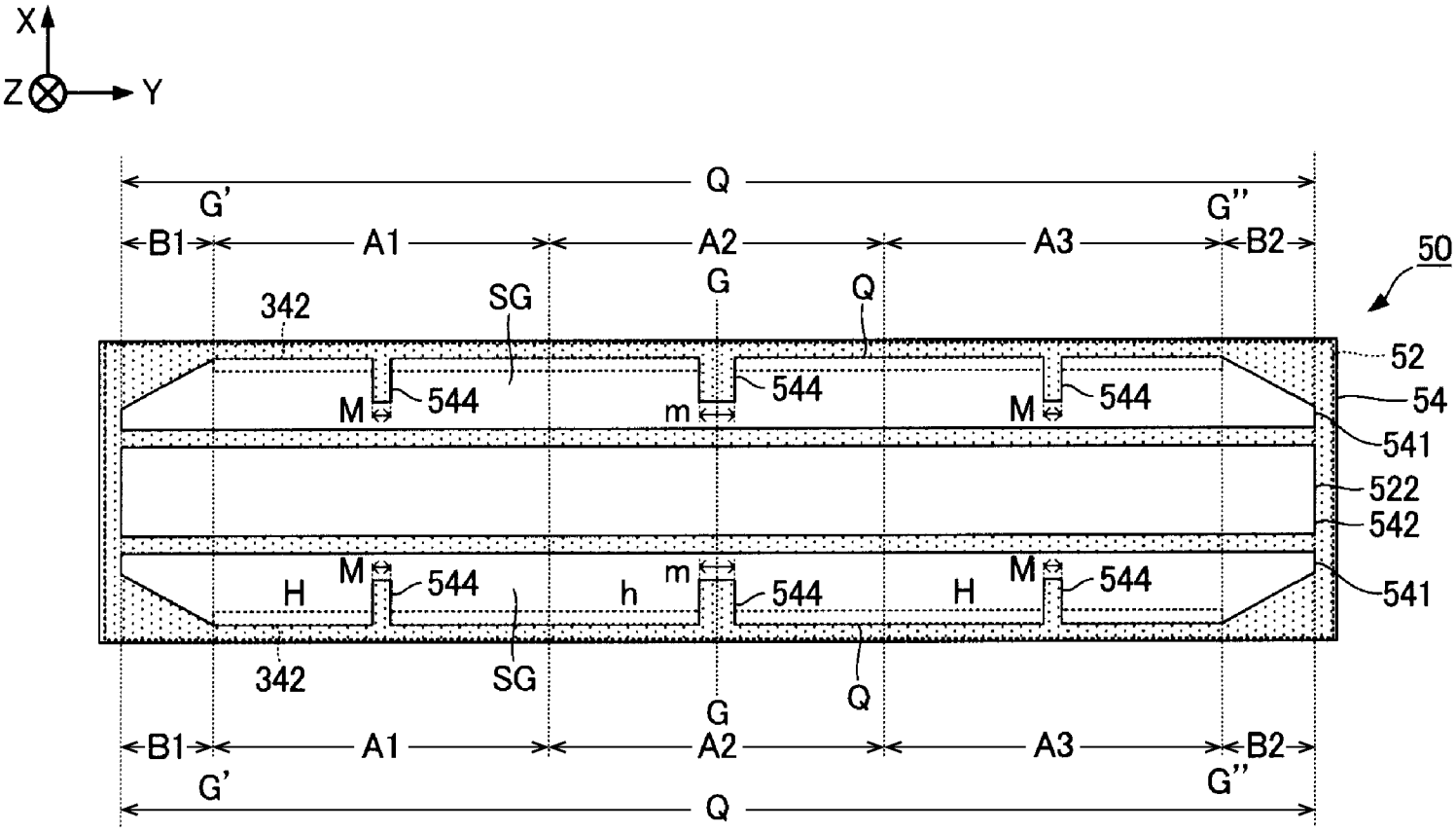
FIG. 12 is a plan view of a compliance plate according to a fourth modification of the first exemplary embodiment.

FIG. 12 is a plan view of a compliance plate 50 according to a fourth modification of the first exemplary embodiment, corresponding to FIG. 6. As illustrated in FIG. 12, the support plate 54 may be provided with bar portions 544 whose widths (widths in the Y direction in FIG. 12) are different between the A1 region (A3 region) and the A2 region. In the example shown in FIG. 12, the width m of the bar portion 544 in the A2 region measured in the Y direction is greater than the width M of the bar portions 544 in the A1 region and the A3 region. Such a configuration in which the support plate 54 is provided with bar portions 544 whose widths are different between the A1 region (A3 region) and the A2 region can also differentiate the characteristic vibration periods of the A1 region (A3 region) and the A2 region from each other and therefore can shift the characteristic vibration period of the whole flexible film 52 to a period such that the pressure vibration of the liquid storage chamber SR does not resonate.

Figure 13:
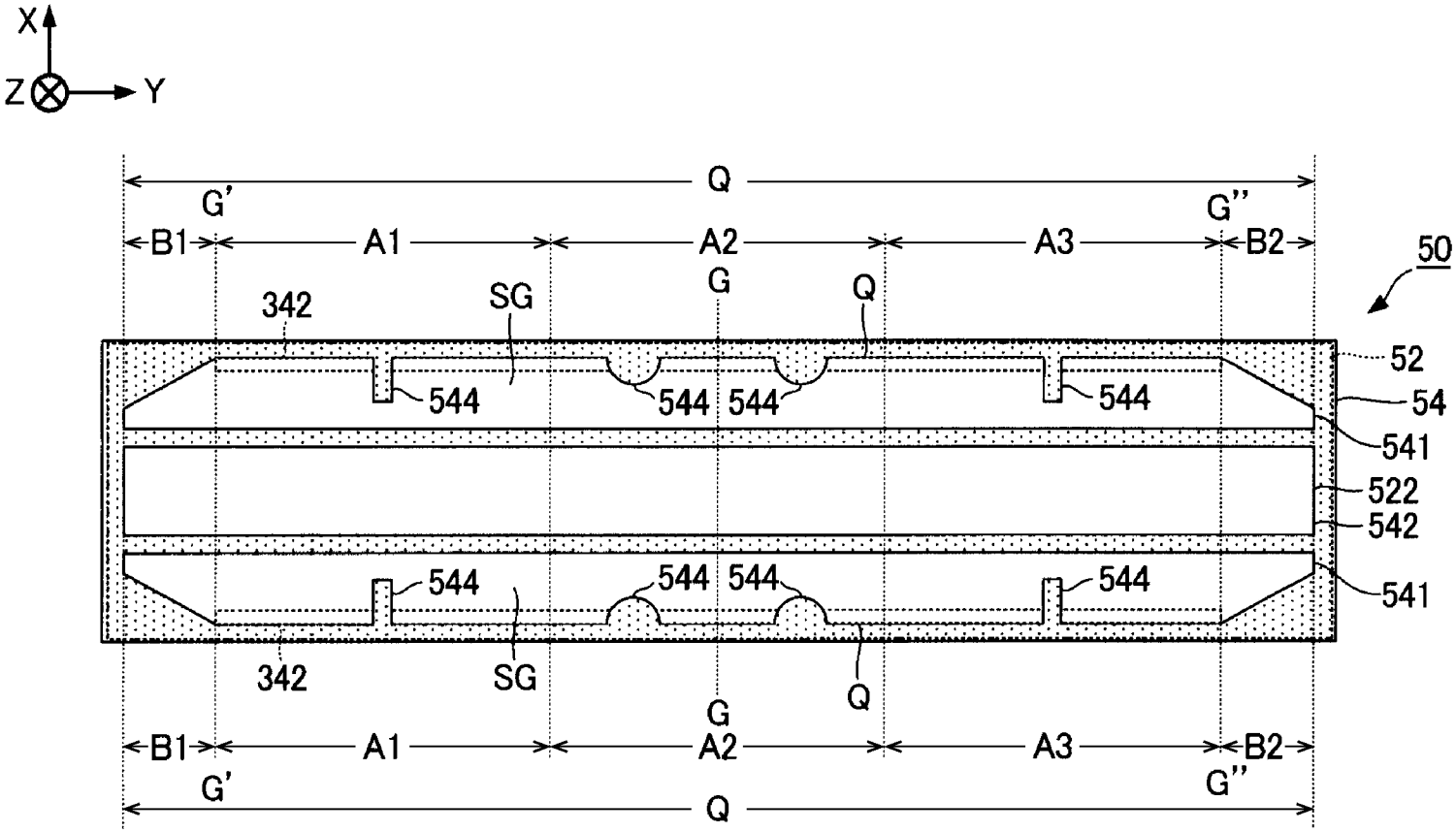
FIG. 13 is a plan view of a compliance plate according to a fifth modification of the first exemplary embodiment.

FIG. 13 is a plan view of a compliance plate 50 according to a fifth modification of the first exemplary embodiment, corresponding to FIG. 6. Although the support plate 54 shown in FIG. 6 has equal numbers of bar portions 544 in the A1 region (A3 region) and the A2 region as an example, the invention is not limited to this example but the numbers of bar portions 544 provided in the A1 region (A3 region) and the A2 region may be different from each other. For example, in FIG. 13, the A2 region is provided with two bar portions 544, that is, the A2 region is provided with a greater number of bar portions 544 than the A1 region and also than the A3 region. Furthermore, in FIG. 13, the bar portions 544 in the A2 region have a semicircular external shape, so that the external shape of the bar portions 544 in the A2 region is different from the external shape of the bar portions 544 in the A1 region and the A3 region. Such a configuration in which the support plate 54 is provided with bar portions 544 that are different in terms of the number and external shape between the A1 region (A3 region) and the A2 region can also differentiate the characteristic vibration periods of the A1 region (A3 region) and the A2 region from each other and therefore can shift the characteristic vibration period of the whole flexible film 52 to a period such that the pressure vibration of the liquid storage chamber SR does not resonate.

Second Exemplary Embodiment

A second exemplary embodiment of the invention will be described. Note that components and the like in the following exemplary embodiments which are substantially the same in operation and function as the components and the like in the first exemplary embodiment will be represented by reference characters used for those in the description of the first exemplary embodiment and detailed description thereof will be omitted as appropriate. While the first exemplary embodiment has been described in conjunction with examples in which the A1 region (A3 region) and the A2 region are different from each other in terms of the shape, position, number, etc. of the bar portions 544, the second exemplary embodiment will be described in conjunction with examples in which the A1 region (A3 region) and the A2 region different from each other in terms of the shape (size, external shape, thickness, etc.), position, number, etc. of island portions 546.

Figure 14:
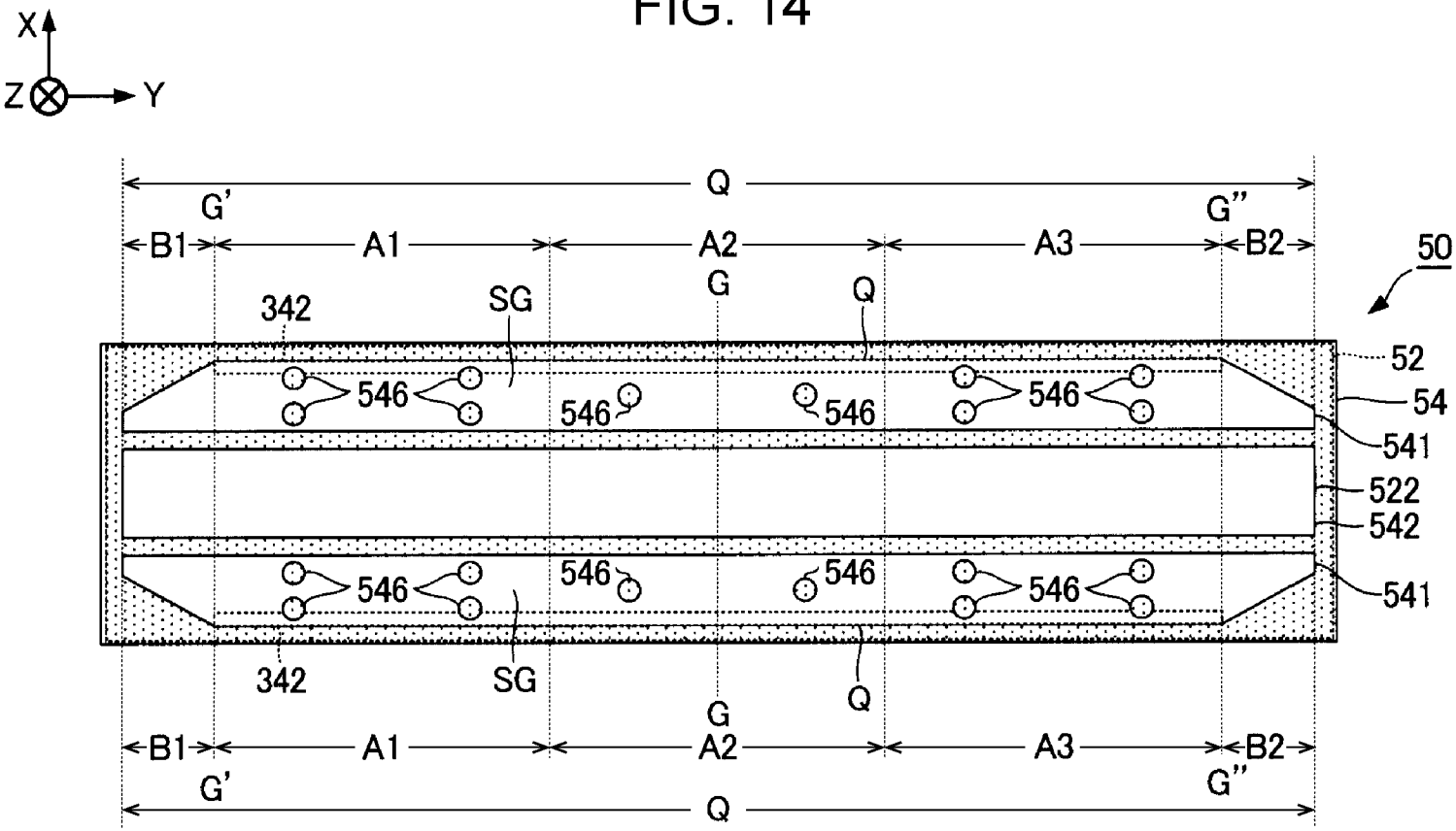
FIG. 14 is a plan view of a compliance plate according to a second exemplary embodiment of the invention.

FIG. 14 is a plan view of a compliance plate 50 according to the second exemplary embodiment. FIG. 14 shows an example in which a support plate 54 is provided with island portions 546 that are different in number between the A1 region (A3 region) and the A2 region. As illustrated in FIG. 14, the island portions 546 are provided within a compliance space SG (within an opening portion 541).

The island portions 546 are provided discontinuously from the support plate 54. Each island portion 546 is fixed to one of a flexible film 52 and a fixture plate 56 by, for example, adhesive, and is not fixed to the other. The second exemplary embodiment will be described in conjunction with an example in which the island portions 546 are fixed to the flexible film 52 and are not fixed to the fixture plate 56. The thickness of each island portion 546 in the Z direction in which the flexible film 52 and the fixture plate 56 face each other is less than the thickness of the compliance space SG. Arranging such island portions 546 can inhibit the flexible film 52 from sticking to the fixture plate 56 at the time of displacement to the fixture plate 56 side.

In FIG. 14, the A2 region is provided with two island portions 546 and the A1 region and the A3 region are each provided with four island portions 546. Such a configuration in which the A1 region (A3 region) and the A2 region are provided with different numbers of island portions 546 can differentiate the characteristic vibration periods of the A1 region (A3 region) and the A2 region from each other and therefore can shift the characteristic vibration period of the whole the flexible film 52 to a period such that the pressure vibration of the liquid storage chamber SR does not resonate. Note that the number of island portions 546 disposed in each region is not limited to that illustrated in FIG. 14. Furthermore, a configuration in which island portions 546 of the A1 region (A3 region) and the A2 region are different in terms of their positions in their respective regions can also differentiate the characteristic vibration periods of the A1 region (A3 region) and the A2 region from each other. Note that although FIG. 14 shows an example in which the island portions 546 have a circular external shape, the invention is not limited by this example, island portions 546 may be rectangular, elliptical, semicircular, etc. in shape.

Figure 15:
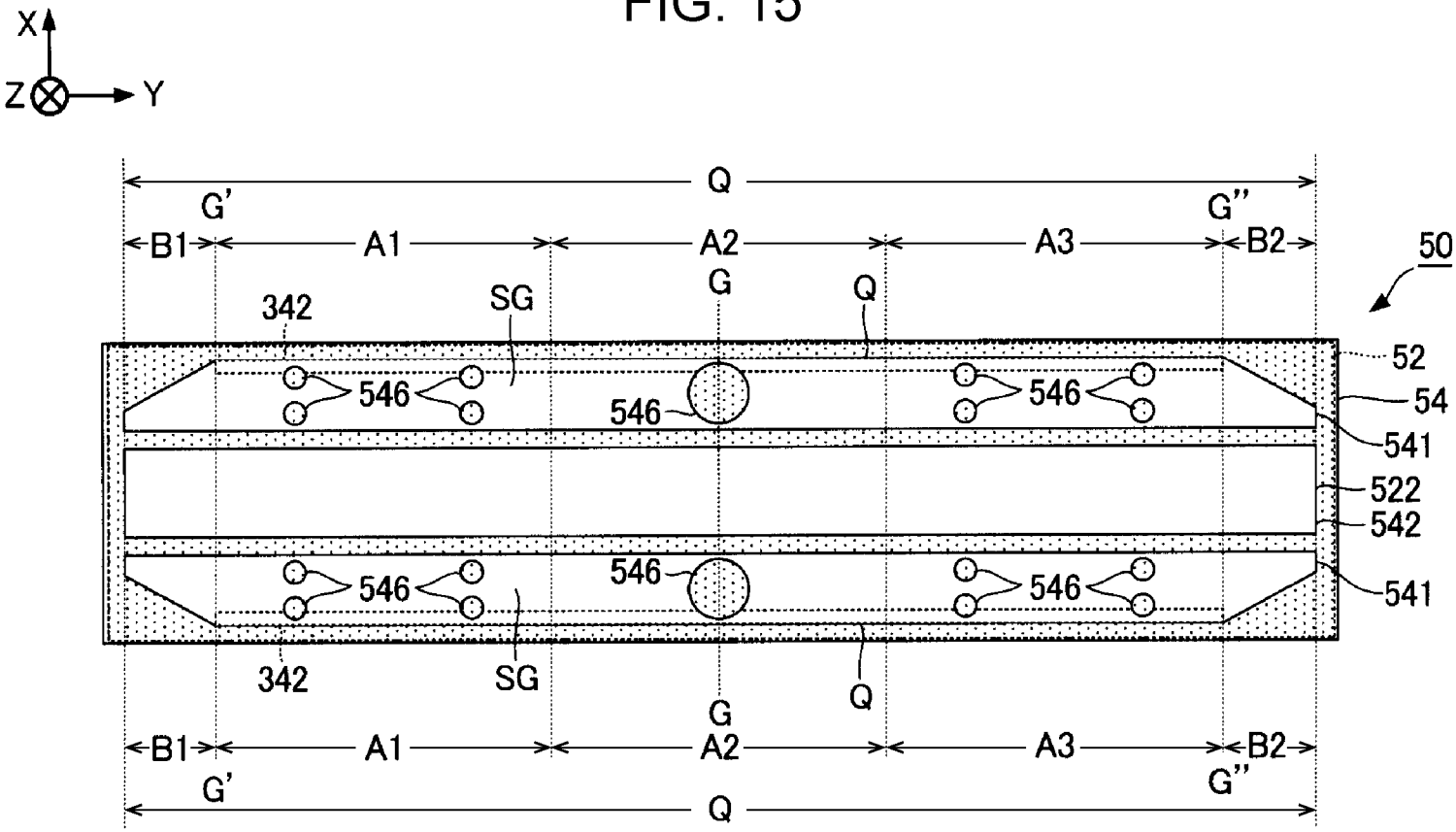
FIG. 15 is a plan view of a compliance plate according to a first modification of the second exemplary embodiment.

FIG. 15 is a plan view of a compliance plate 50 according to a first modification of the second exemplary embodiment, corresponding to FIG. 14. Although in the support plate 54 in the example illustrated in FIG. 14, the A1 region (A3 region) and the A2 region are different from each other in terms of the number of island portions 546, the invention is not limited by this example. An example in which the A1 region (A3 region) and the A2 region are different from each in terms of the size of island portions 546 will be described. For example, in FIG. 15, the size of an island portion 546 provided in the A2 region is larger than the size of each one of four island portions 546 provided in each of the A1 region and the A3 region. Such a configuration in which the A1 region (A3 region) and the A2 region are different from each other in terms of the size of island portions 546 can differentiate the characteristic vibration periods of the A1 region (A3 region) and the A2 region from each other and therefore can shift the characteristic vibration period of the whole flexible film 52 to a period such that the pressure vibration of the liquid storage chamber SR does not resonate.

Figure 16:
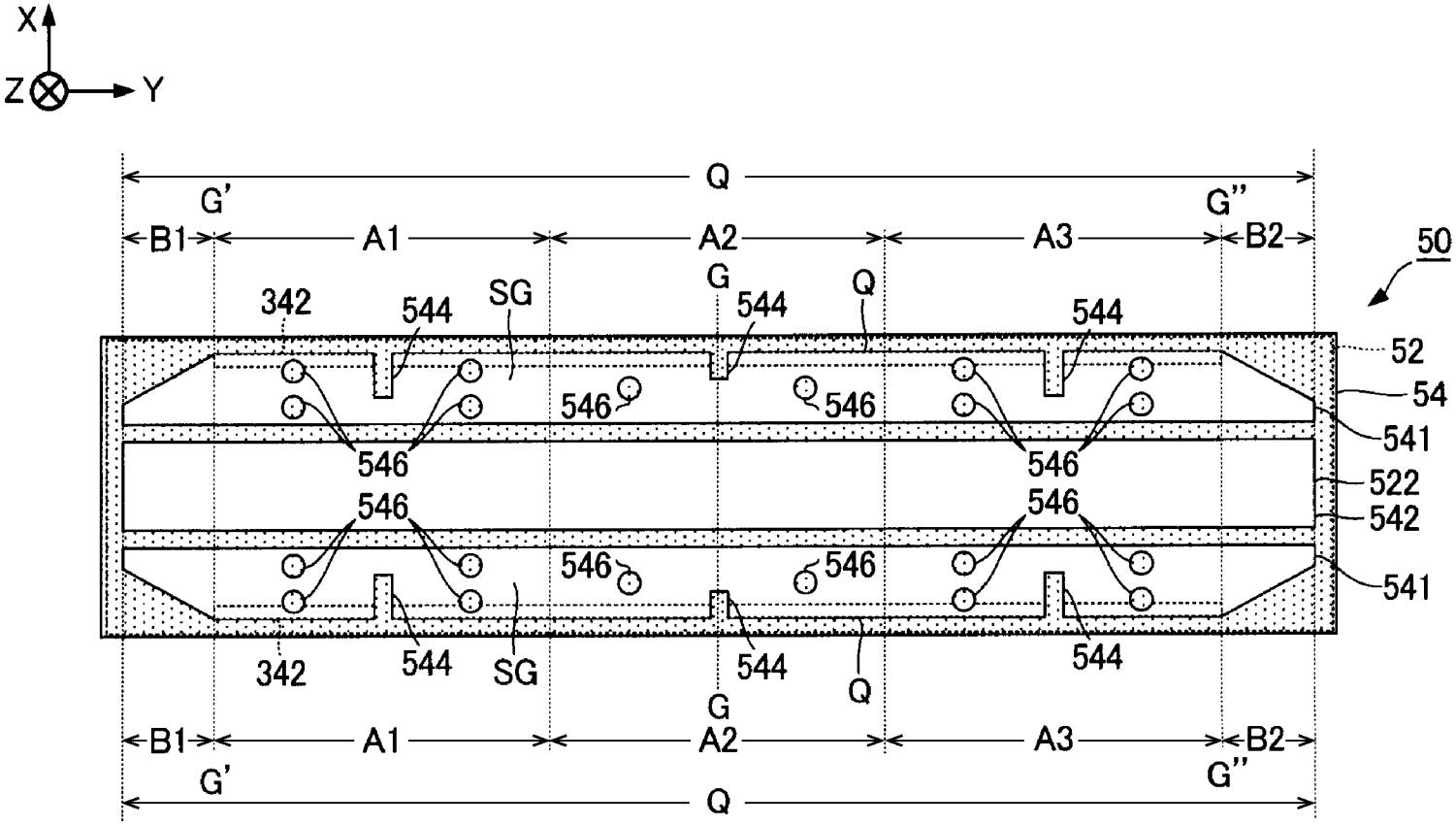
FIG. 16 is a plan view of a compliance plate according to a second modification of the second exemplary embodiment.

FIG. 16 is a plan view of a compliance plate 50 according to second modification of the second exemplary embodiment. In FIG. 16, each of the A1 region, the A2 region, and the A3 region is provided with bar portions 544 similar to those illustrated in FIG. 6 and island portions 546 similar to those illustrated in FIG. 14. As illustrated in FIG. 16, the A1 region (A3 region) and the A2 region may also be provided with bar portions 544 and island portions 546 that are different between the two regions in terms of position, number, and shape. Such a configuration that includes island portions 546 that are different in size between the A1 region (A3 region) and the A2 region can differentiate the characteristic vibration periods of the A1 region (A3 region) and the A2 region from each other and therefore can shift the characteristic vibration period of the whole flexible film 52 to a period such that the pressure vibration of the liquid storage chamber SR does not resonate.

Although in the foregoing exemplary embodiments and the foregoing modifications thereof, the A1 region (A3 region) and the A2 region are differentiated in characteristic vibration period, the invention is not limited to those embodiments and modifications but any one of the A1 region, the A2 region, and the A3 region and a region other than the three regions may be differentiated in characteristic vibration period. Furthermore, although in the foregoing embodiments and modifications, the region in the compliance region Q whose width in the X directions is constant (the region between the imaginary line G'-G' and the imaginary line G"-G" in the Y directions) is equally divided into the three regions: the A1 region, the A2 region, and the A3 region, the invention is not limited to those embodiments and modifications but the foregoing region may be equally divided into two regions or four or more regions and may also be unequally divided.

Furthermore, in the compliance region Q in the foregoing exemplary embodiments and modifications, an end region B1 on the negative Y direction side of the imaginary line G'-G' and an end region B2 on the positive Y direction side of the imaginary line G"-G" may also be provided with either bar portions 544 or island portions 546, or both. In that case, the end regions B1 and B2 may be regions separate from the A1 region, the A2 region, and the A3 region. Alternatively, the end regions B1 may be included in the adjacent A1 region, and the end region B2 may be included in or combined with the adjacent A3 region. A configuration in which, of these regions, two arbitrarily selected regions, that is, a first region and a second region, have mutually different characteristic vibration periods may also be adopted.

Modifications

The exemplary embodiments and forms described above can be modified in various manners. Concrete modifications will be presented below as examples. Two or more forms arbitrarily selected from the following modification examples and the exemplary embodiments and forms described above can be combined as appropriate as long as the two or more forms do not contradict each other.

(1) Although the foregoing exemplary embodiments have been described in conjunction with a serial head that repeatedly moves the carriage 18 on which the liquid discharge head 20 is mounted back and forth in the X directions, the invention is applicable also to a line head equipped with a liquid discharge head 20 that extends over the entire width of the medium 11.

(2) Although the foregoing exemplary embodiments have been described in conjunction with a piezoelectric type liquid discharge head 20 that employs piezoelectric elements that produce mechanical vibration for the pressure chambers, it is also possible to adopt a thermal type liquid discharge head that employs heating elements that thermally produce bubbles within the pressure chambers.

(3) The liquid discharge apparatus 10 illustrated as an example in conjunction with the foregoing exemplary embodiments can be adopted not only in appliances dedicated to printing but also in various other appliances such as facsimile apparatuses and copying machines. As may be apparent, the use of the liquid discharge apparatus 10 according to the invention is not limited to printing. For example, a liquid discharge apparatus that discharges solutions of color materials can be used as production apparatuses that form color filters of liquid crystal display apparatuses or form organic electroluminescence (EL) displays, field emission displays (FEDs), etc. Furthermore, a liquid discharge apparatus that discharges solutions of electroconductive materials can be used as manufacture apparatuses that form wiring and electrodes on wire substrates. Still further, a liquid discharge apparatus can also be used as a chip production apparatus that discharges solutions of bio-organic materials, which are other examples of liquid.

The entire disclosure of Japanese Patent Application No. 2017-135309, filed Jul. 11, 2017 is expressly incorporated by reference herein.

What is claimed is:

1. A compliance plate comprising:

a flexible film that forms a portion of a wall surface of a liquid storage chamber that is supplied with a liquid that is to be discharged from a nozzle;

a support plate that supports the flexible film at an opposite side of the flexible film to the liquid storage chamber and that has an opening portion that exposes the flexible film; a closure plate that closes the opening portion; and a plurality of regions that include a first region and a second region that have a compliance function, the first region and the second region having mutually different characteristic vibration periods because the first and second regions have differences in bar portions or island portions that are included in the first and second regions.

2. The compliance plate according to claim 1, wherein the support plate includes the bar portions, the bar portions protruding to a side of the opening portion, and wherein the first region and the second region are provided with bar portions that are different in shape between the first region and the second region.

3. The compliance plate according to claim 2, wherein the support plate includes bar portions protruding into the opening portion from one or both of mutually facing side surfaces of the opening portion, and wherein the first region and the second region are different from each other in position of the bar portions in each region.

4. The compliance plate according to claim 2, wherein the first region and the second region are provided with mutually different numbers of the bar portions.

5. The compliance plate according to claim 1, wherein the support plate is provided with the island portions, the island portions being present inside the opening portion, and wherein the first region and the second region are provided with the island portions that are different in shape between the first region and the second region.

6. The compliance plate according to claim 5, wherein the first region and the second region are provided with mutually different numbers of the island portions.

7. The compliance plate according to claim 1, wherein the flexible film has, at locations corresponding to the first region and the second region, portions that are different between the first region and the second region in thickness of the flexible film.

8. A liquid discharge head comprising:

a flexible film that forms a portion of a wall surface of a liquid storage chamber that is supplied with a liquid that is to be discharged from a nozzle;

a support plate that supports the flexible film at an opposite side of the flexible film to the liquid storage chamber and that has an opening portion that exposes the flexible film;

wherein the support plate includes a first bar portion protruding to a side of the opening portion and a second bar portion protruding to a side of the opening portion, and wherein the first and the second bar portions are different in shape or size.

9. A liquid discharge head comprising:

a flexible film that forms a portion of a wall surface of a liquid storage chamber that is supplied with a liquid that is to be discharged from a nozzle;

a support plate that supports the flexible film at an opposite side of the flexible film to the liquid storage chamber and that has an opening portion that exposes the flexible film;

wherein the support plate is provided with a first island portion and a second island portion inside the opening portion, and wherein the first and the second island portions are different in shape or size.

10. A liquid discharge head comprising:

a flexible film that forms a portion of a wall surface of a liquid storage chamber that is supplied with a liquid that is to be discharged from a nozzle;

a support plate that supports the flexible film at an opposite side of the flexible film to the liquid storage chamber and that has an opening portion that exposes the flexible film;

wherein the flexible film includes a first region and a second region, the second region is different in thickness from the first region.

* * * * *